US007942290B2

(12) United States Patent
Halliburton et al.

(10) Patent No.: US 7,942,290 B2
(45) Date of Patent: May 17, 2011

(54) TICKET DISPENSER

(75) Inventors: Ronald Halliburton, Delray Beach, FL (US); David Hodge, Boca Raton, FL (US); Curtis Elrod, Boca Raton, FL (US)

(73) Assignee: Benchmark Entertainment, L.C., Hypoluxo, FL (US)

( * ) Notice: Subject to any disclaimer, the term of this patent is extended or adjusted under 35 U.S.C. 154(b) by 772 days.

(21) Appl. No.: 11/504,712

(22) Filed: Aug. 16, 2006

(65) Prior Publication Data

US 2007/0051259 A1 Mar. 8, 2007

Related U.S. Application Data

(60) Provisional application No. 60/708,384, filed on Aug. 16, 2005.

(51) Int. Cl.
*G07F 11/72* (2006.01)

(52) U.S. Cl. ..... 221/30; 221/26

(58) Field of Classification Search ..... None
See application file for complete search history.

(56) References Cited

U.S. PATENT DOCUMENTS

| | | | | | |
|---|---|---|---|---|---|
| 3,456,854 | A | | 7/1969 | Condy | |
| 3,655,109 | A | | 4/1972 | Stevens | |
| 4,033,494 | A | | 7/1977 | Middleton | |
| 4,503,962 | A | * | 3/1985 | Mushell | 194/235 |
| 4,579,269 | A | * | 4/1986 | Lasley | 226/188 |
| 5,370,264 | A | * | 12/1994 | Wen-Chih | 221/259 |
| 5,833,104 | A | | 11/1998 | Horniak | |
| 6,135,335 | A | | 10/2000 | Shoemaker | |
| 6,578,735 | B1 | | 6/2003 | Mothwurth | |
| 6,616,009 | B2 | * | 9/2003 | Yang | 221/71 |
| 6,712,253 | B2 | * | 3/2004 | Hargrave et al. | 225/100 |
| 6,726,077 | B2 | * | 4/2004 | Roberts et al. | 225/103 |
| 6,871,755 | B2 | | 3/2005 | Devries | |
| 2004/0245264 | A1 | | 12/2004 | Mellet | |

* cited by examiner

*Primary Examiner* — Gene Crawford
*Assistant Examiner* — Timothy R Waggoner
(74) *Attorney, Agent, or Firm* — Andrew C. Aitken

(57) ABSTRACT

An improved device for distributing tickets or coupons is disclosed that includes a plurality of ticket chutes each having a ticket guide assembly for guiding tickets through the chute and an exit slot and biasing tickets against a drive wheel which engages the tickets. The drive wheel is powered by a motor which uses a drive belt to power a screw gear which in turn rotates and axle on which the drive wheel is attached. The motor is activated by a controller in response to an input signal and the controller may also received input from an optical sensor in the chute for the detection of the tickets and the movement of the motor.

12 Claims, 8 Drawing Sheets

TICKET DISPENSER

CROSS REFERENCE TO RELATED APPLICATION

This application claims the benefit of U.S. Provisional Application No. 60/708,384, filed Aug. 16, 2005, entitled "Dual Ticket Dispenser."

The present invention relates to an improved device for automatically dispensing tickets from redemption games. Redemption games are a class of amusement game that are typically found in arcades and family fun centers wherein, in response to the successful exercise of skillful play, a player is rewarded with tickets. These tickets may subsequently be redeemed for prizes. Redemption games are typically activated by the insertion of coins, tokens and, more recently, prepaid debit cards. The game is played and, upon a successful outcome, tickets are distributed to the player by a ticket dispenser. The number of tickets that is distributed is typically dependent on the respective score of the player. While the invention was developed for the redemption game industry, it may be used for the distribution of any kind of ticket or similar product, such as movie tickets, carnival tickets, or coupons used for other purposes.

BACKGROUND OF THE INVENTION

Ticket dispensers are used on most redemption games in arcades today. A new popular redemption game could dispense up to 100,000 tickets a week, therefore requiring a number of ticket reloads on a daily basis. Tickets or coupons for redemption games are commonly provided in stacks, and in more limited circumstances, rolls. In circumstances where the tickets are distributed from games, usually sets of five tickets are stacked together which are repeatedly folded back upon themselves. Between each ticket, a perforation is provided that facilitates the separation of the tickets. In some circumstances the tickets may also be provided with a unique serial number or code. More recently, tickets have been also provided with a bar code that can be read by an optical scanner. The bar code may contain information that is unique to a particular location so that, when the tickets are redeemed, the operator can confirm that the tickets originated from the same location or contains information that may ensure the ticket is genuine.

Because players are frequently awarded tickets, ticket dispensers are subject to significant wear over time. After the tickets are distributed from a distribution device, the player will tear the tickets from the dispenser along the perforation line. This tearing action creates paper dust and debris that can clog the ticket slot and other machinery used to distribute the tickets. In addition, players will often attempt to pull the tickets from the slot in anticipation of the legitimate distribution or in a misguided attempt to improperly acquire more tickets than the player has actually earned by playing the game. This problem, referred to as reeling, is problematic and some conventional ticket dispensers may not have mechanisms to prevent this practice. While in some circumstances pulling on the tickets may result in tearing the tickets along a perforation, in other situations the tickets may tear at other locations. Tearing tickets in the dispensing chute or at locations other than the ticket exit slot may cause the tickets to jam. A further problem that occurs with popular games is they will run out of tickets during heavy use. Yet a further problem with the distribution of tickets is that a ticket or coupon itself may have a bend or deformation or other foreign matter is introduced to the system that causes a jam in the chute.

Accordingly, primary problems with existing and conventional ticket dispensers are (1) players improperly pulling tickets while the ticket dispenser is dispensing tickets, (2) running out of tickets during primetime game play, (3) ticket jams caused by game players trying to cheat the game, (4) ticket jams due to the ticket splice or defects in the tickets or foreign matter such as ripped tickets, and (5) the exit slot may become jammed causing a jam. For example, in connection with the exit slot jam problem, a jam may cause the spokes of a drive wheel may break through and damage the tickets making them unable to be driven by the toothed ticket drive gears.

If the ticket chute jams, the motor driving the tickets may stall causing the motor or the driver chip to burn out or become damaged. If the motor itself is damaged the repair of the device becomes costly. These circumstances and other mechanical problems will sometimes result in the malfunction of the ticket distributor. When the ticket dispenser is not working, the game will remain idle, revenue is lost and customers will complain. Typically when the machines are experiencing heavy use, in view of multiple demands on the game operators, the rapid service of the game to place it back in service is not achieved.

OBJECTS OF THE INVENTION

Thus, it is an object of the present invention to improve the reliability of ticket dispensing machines. It is a further object of the invention to provide a ticket dispensing machine that can be easily serviced and reloaded with tickets.

BRIEF SUMMARY OF THE INVENTION

The present invention is directed to an improved ticket dispenser that includes a dual chute which is controlled by a single controller. The dispenser will fit into a similar sized space as existing ticket dispensers. In the event that a first ticket dispenser jams, the center light source of the motor encoder will provide a signal, or there will be the absence of an expected signal, which is interpreted as a malfunction or the tickets have run out. The controller can then send a signal to the drive motor for an alternative ticket distribution chute. For example, a ticket sensor is provided that detects the passage of tickets and, in the absence of the receipt of the signal, the controller will automatically activate the second chute. The dispenser uses a screw gear arrangement that drives a gear, that in turn drives the ticket driver gear. The use of the screw gear in one feature that prevents players from pulling on the tickets through the chute. A ticket rail guide pivots down from the top giving easy access to the chute for reloading operations and service. In addition, a light source and optical sensor are provided in the center of the ticket dispenser chute. Light emitted from the source reflects back from the tickets or back from an opposite mirror to a light sensor that can provide signals to the controller. These signals may include the information reflecting passage of the center ticket hole or information reflected back from a bar code provided on the ticket. In addition, the location of the rotor of the motor is detected and a further signal that is also provided to the controller. This information may also be used to control the distribution of the tickets.

When the ticket reservoir is out of tickets or the ticket dispenser has malfunctioned, this condition is detected and a diode will illuminate and thereby provide a visual indication that the ticket dispenser requires attention by the operator. When the motor encoder senses any slow down, a signal is sent back to the controller and the software will shut down the motor preventing motor burnout. When all of the chutes of the ticket dispenser are inoperative, the game controller provides a signal to prevent further play of the game.

When tickets are pulled while dispensing, pressure is applied across a serrated cutter. The cutter has a pressure angle of approximately 48 degrees that assures a cutoff, instead of de-reeling tickets from the ticket hopper.

While the embodiment disclosed depicts a dual ticket dispenser, it is contemplated that devices with additional ticket chute may be provided and controlled by a single controller.

DETAILED DESCRIPTION OF THE INVENTION

Figure 1:
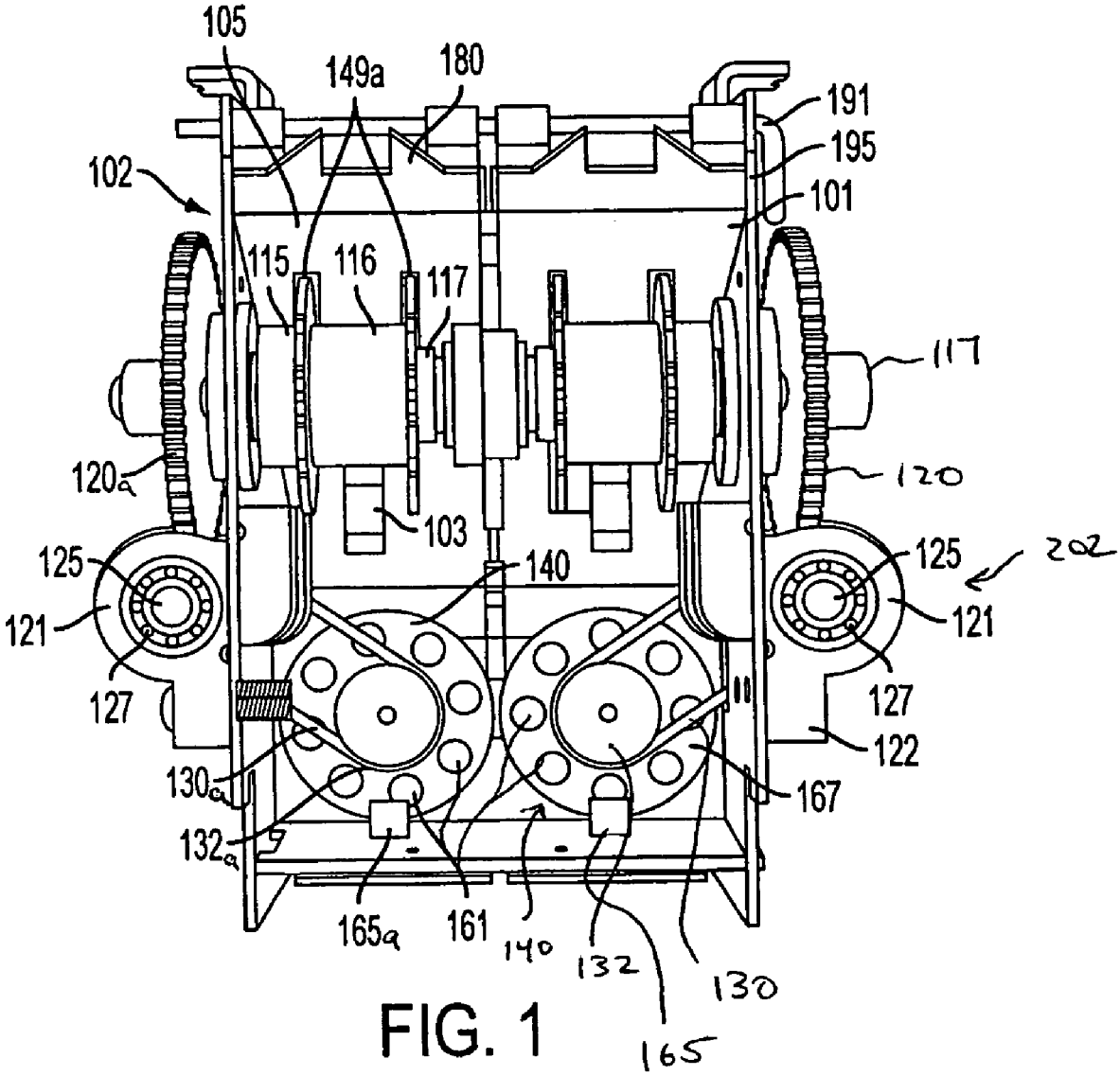
FIG. 1 is a front view in elevation of the ticket dispenser according to the invention.
Figure 2:
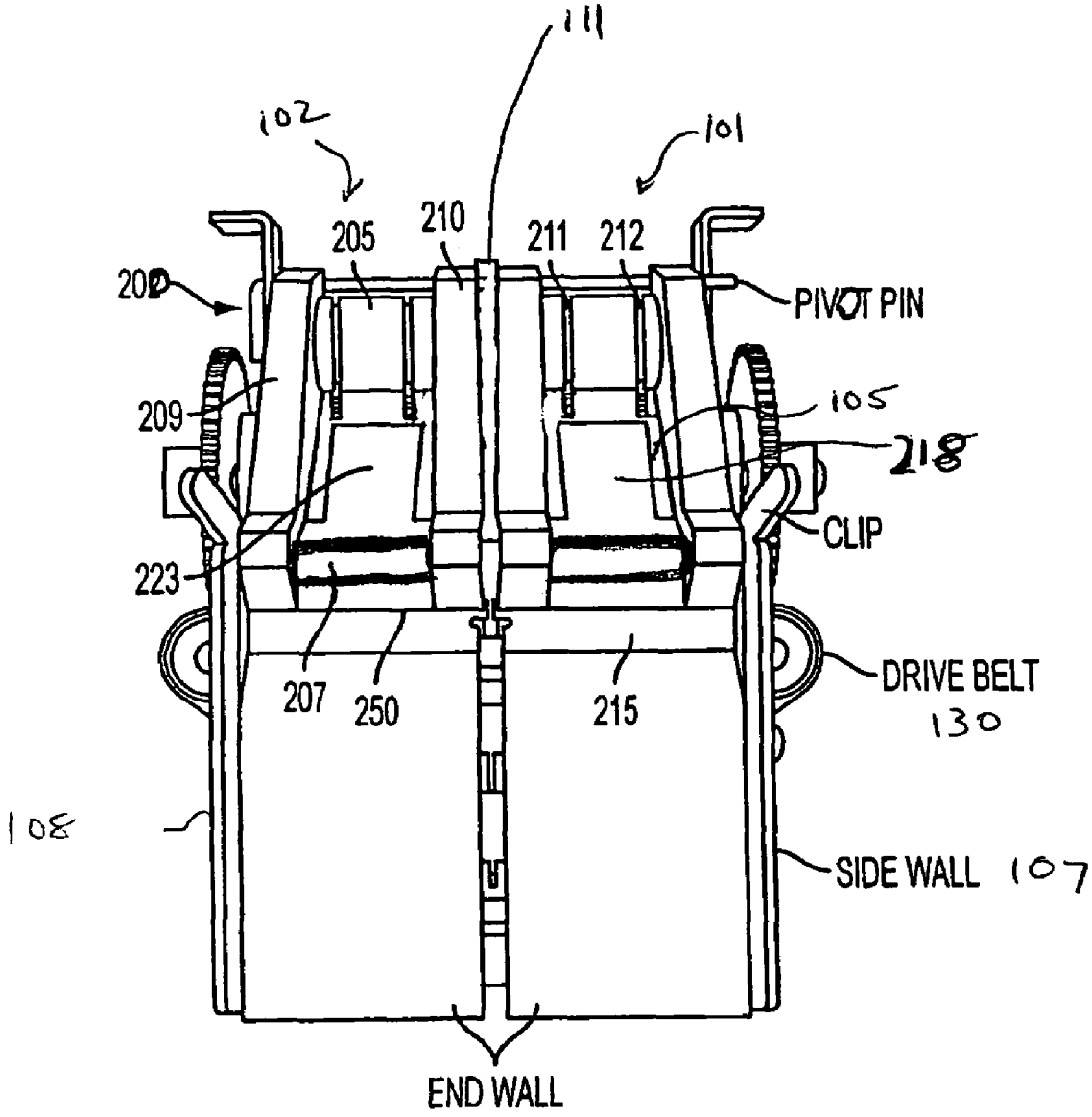
FIG. 2 is a rear view in elevation of the ticket dispenser according to the invention.

Referring to FIGS. 1 and 2 the improved ticket dispenser device includes a pair of ticket chutes 101 and 102 that are sized to receive conventional paper redemption tickets. The chute 101 is defined by floor 105, sidewall 107 and middle separator wall 111 that generally defines a "u-shaped" channel having a flat bottom. In the center of chute 101 is a light source and light sensor 103. The light source emits light that is reflected back to the light sensor from the tickets or from an opposite mirror 218. Also seen in FIG. 1 is ticket driver wheel 115 that is attached to axle 117. Ticket driver wheel 115 includes spokes that extend through slots provided through the bottom surface 105 of the chute and engage and drive tickets that are traveling through the chute. Axle 117 is driven by the engagement of tooth gear 120 by screw gear 202. The screw gear 202 is attached to the side by screw gear mount 121 and 122 and rotates on axis 125. As shown in FIG. 1 the screw gear rotates in bearing 127. Screw gear 202 in turn is driven by drive belt 130 that is connected to drive wheel 132 of motor 140. Motor 140 includes a series of magnets 161 (or a material that may be detected by a magnetic field) and a detector 165 that will detect the electromagnetic field as it passes by stationary detector 165. Accordingly the motor 140 drives drive belt 130 which drives the screw gear 202 which drives toothed gear 120 which is connected to axle 117 to turn the toothed driver wheel 115 that engages the tickets in the chute.

While a toothed driver wheel is a preferred embodiment it is contemplated that the tickets may be driven through the chute in alternative manners such as a drive belt or a frictional drive wheel that may engage tickets and pull the tickets from a ticket reservoir. For example, a drive wheel may be that includes a surface such as rubber, polyurethane or other material having a high coefficient of friction wherein the wheel can engage tickets in the chute.

Figure 3:
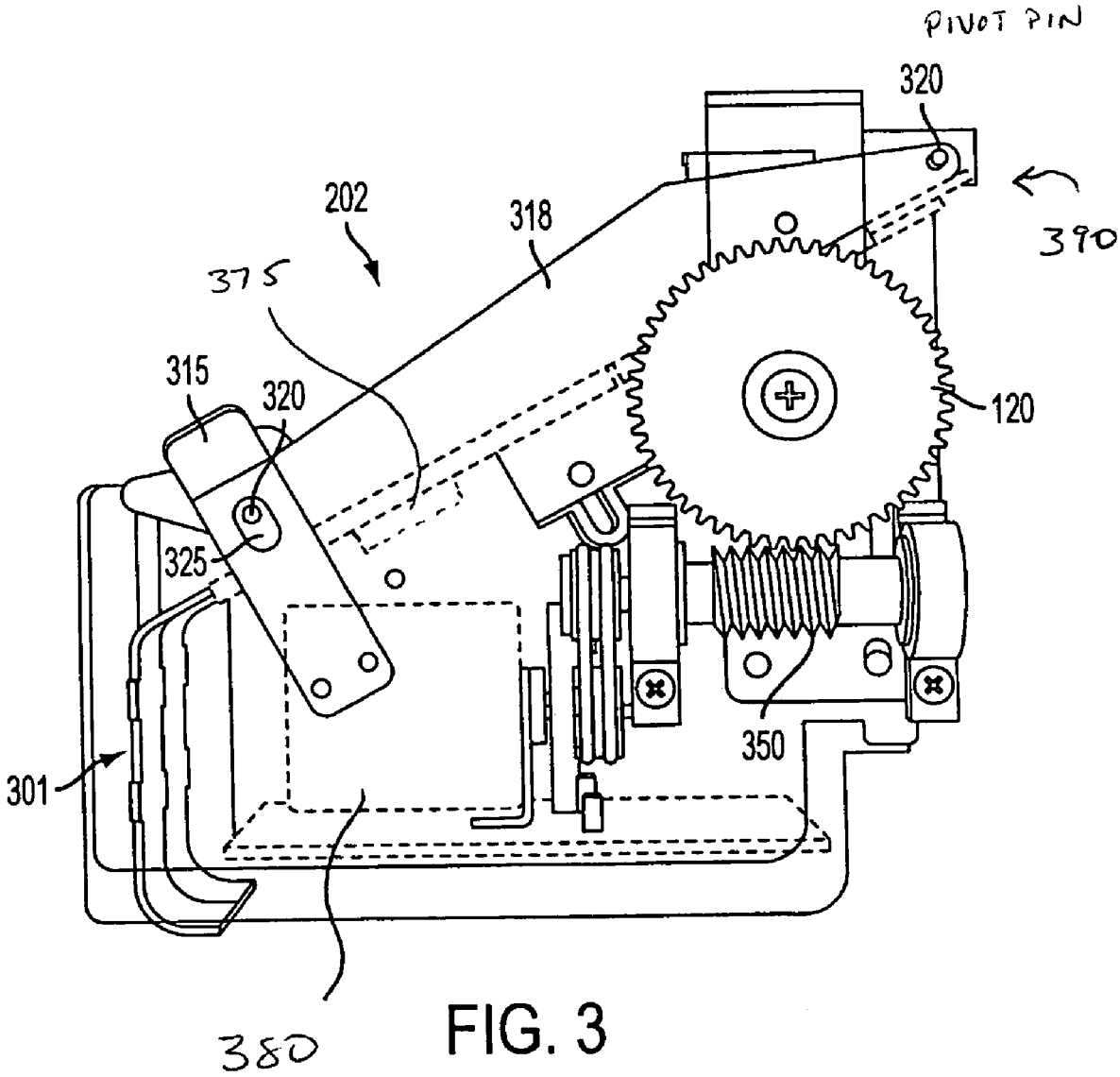
FIG. 3 is a side view with the motor and other elements shown in phantom.
Figure 4:
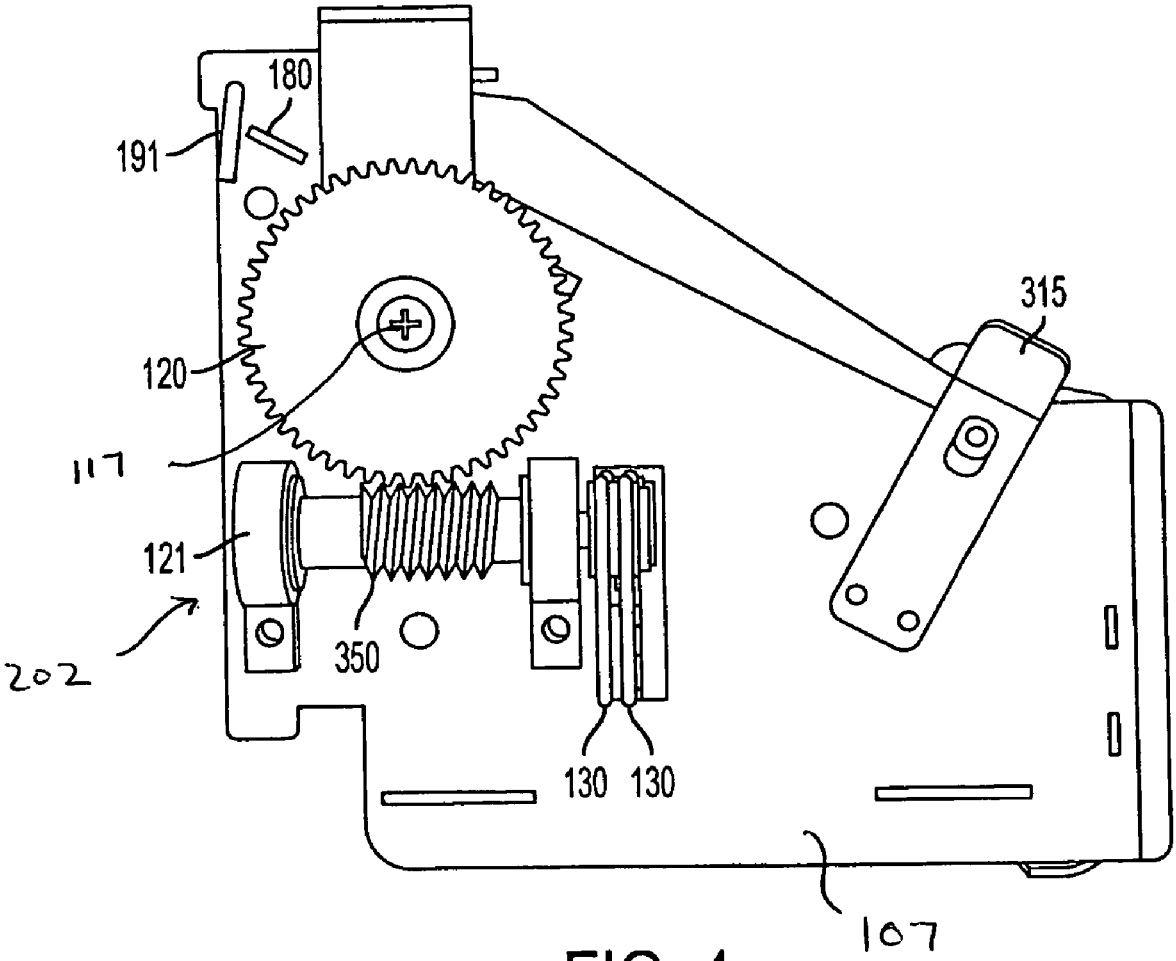
FIG. 4 is a side view of the ticket dispenser.
Figure 5:
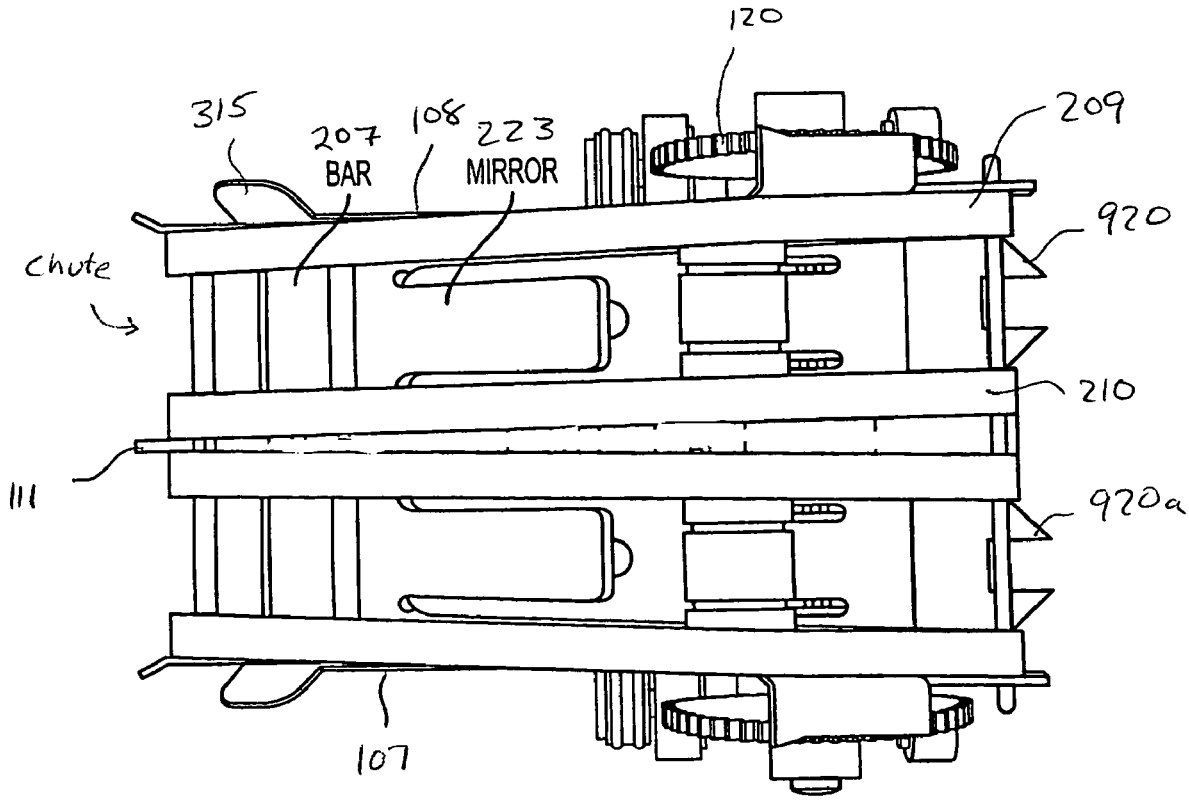
FIG. 5 is a top view of the dispenser showing the chutes and ticket guide.
Figure 6:
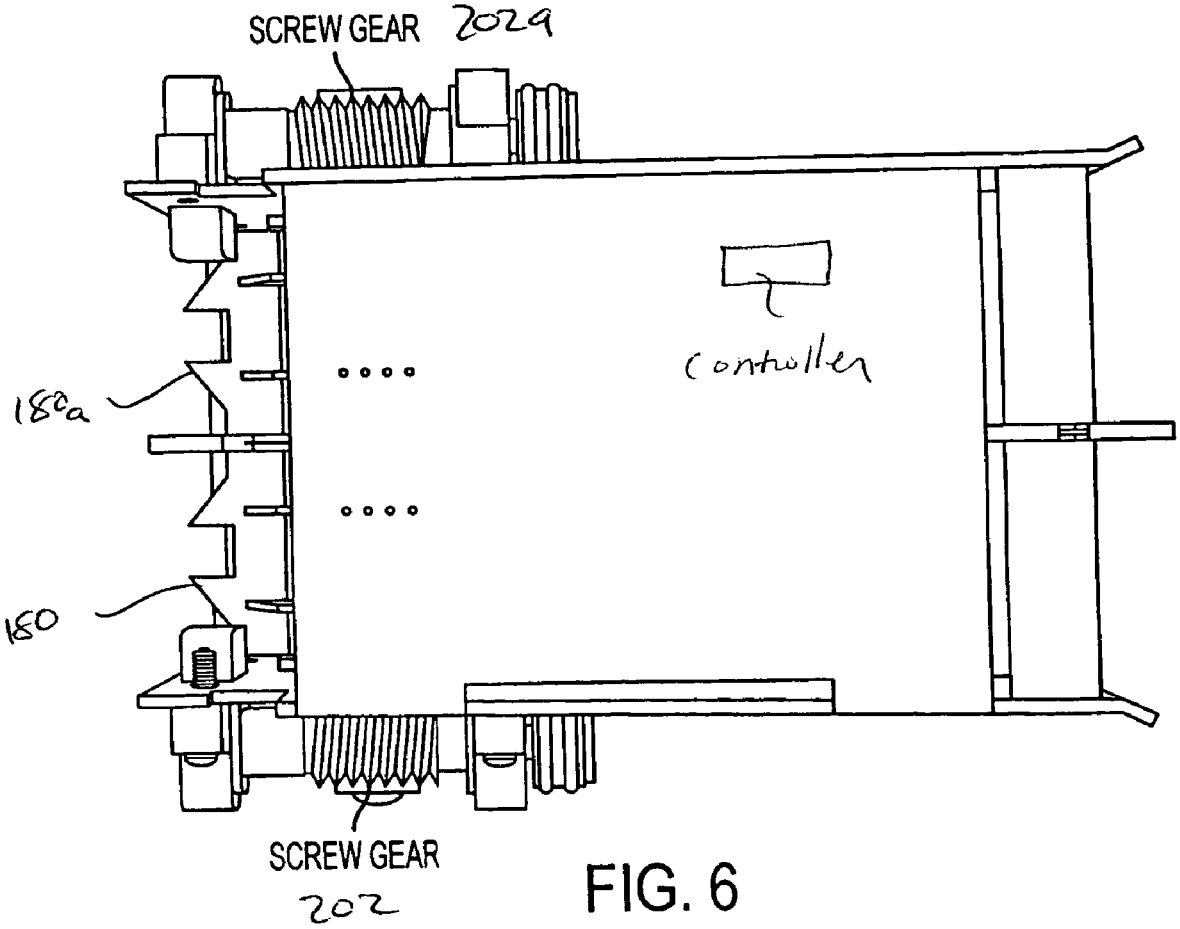
FIG. 6 is a bottom view of the dispenser without any detail of the circuit board, components and leads thereto.
Figure 7:
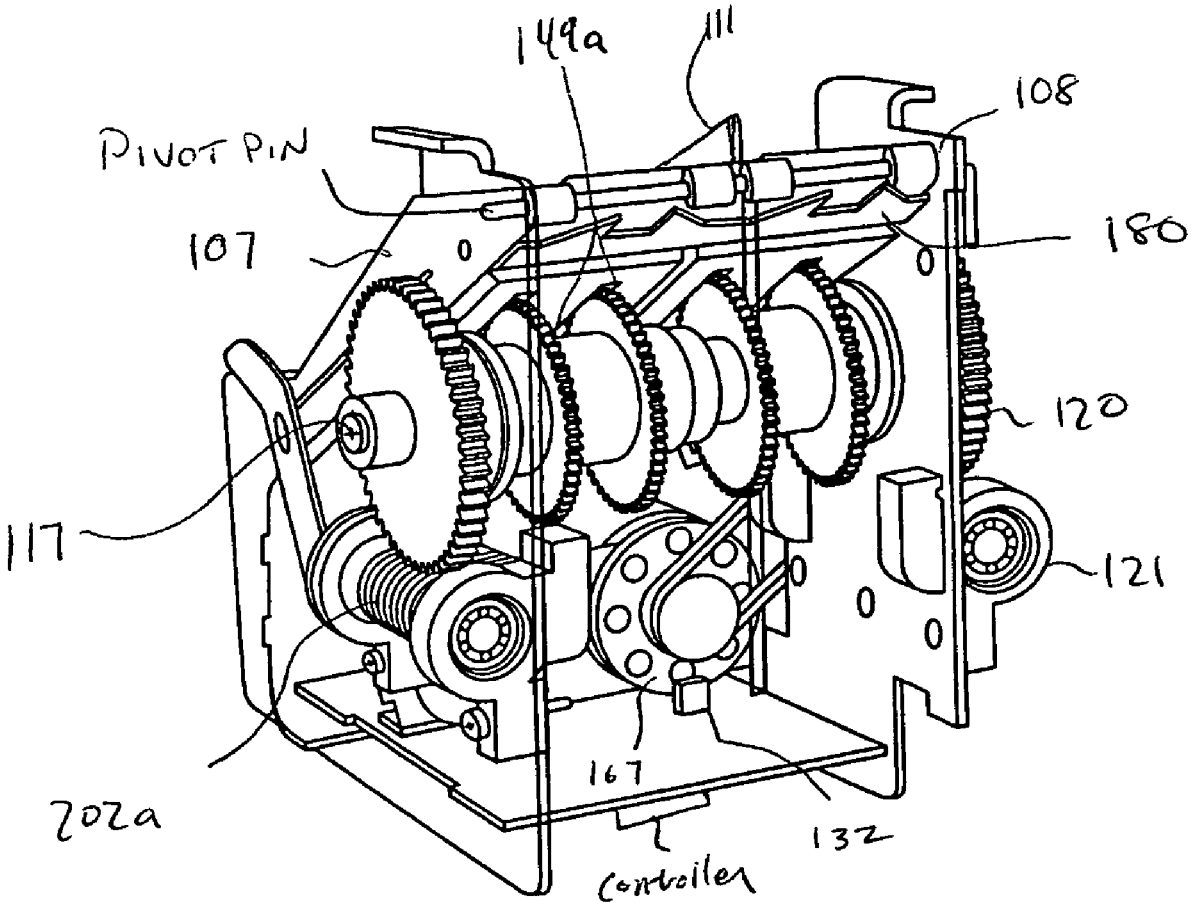
FIG. 7 is an isometric view of the device.

Now referring to FIG. 2, on top of the chute 102 is ticket guide assembly 202 that includes guide roller 205 and guide bar 207. Guide roller 205 is allowed to freely rotate in a bearing provided on opposite rails 209 and 210 of ticket guide assembly 202. The guide roller 205 has parallel annular grooves that receive the spokes of the ticket driving wheel 115 which extend through the floor of the chute, and provides a downward force on the tickets. Tickets are introduced to the chute at location 250 and are pulled through the chute by the engagement of the toothed drive wheel 115. All of the elements of the ticket guide assembly provide a downward force on the tickets to assist with the engagement by the drive wheel but allow the ticket to slide through the chute. As best seen in FIG. 3, the ticket guide assembly 202 is attached to the bottom section of the ticket dispenser by clip 315 and pivot rod 320. Ticket guide assembly 202 thus pivots at location 320 to open up and gain access to the chute. Also seen in FIG. 3 is the screw gear 202 that is mounted on axis 125. As the screw gear turns, both the tooth gear 120 and the drive wheel 115 are moved causing the tickets to be driven through the chute.

Figure 9:
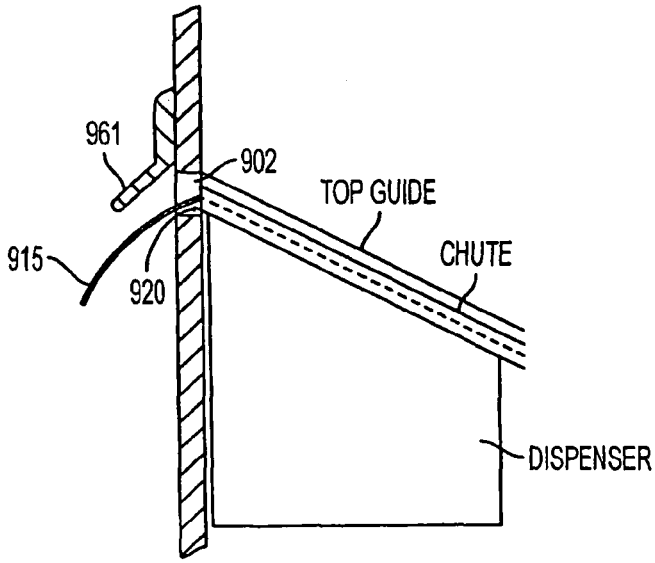
FIG. 9 is a side sectional view of the ticket dispenser and the hood converting the ticket slot.
Figure 10:
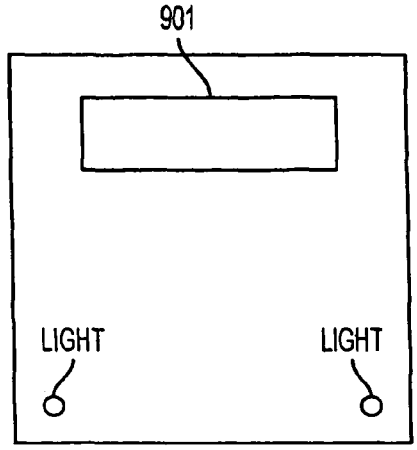
FIG. 10 is a front view of the hood from under which the tickets are

When the motor 380 is operating, in some circumstances players may improperly attempt to pull the tickets from the ticket exit slot 902 located near the top of the chute 390. This practice, referred to a "reeling" or "de-reeling", is a major cause of problems wherein a dispenser distributes more tickets than that which were awarded. While it is possible to try and brake the motor, these efforts are generally not satisfactory. The use of a screw gear is one manner that prevents this problem because the screw gear will not move in response to pulling the tickets. A second feature that addresses this problem which is illustrated in FIG. 9, is the combination of providing the chute at an upwards angle and a ticket hood 961 at a downward angle, and the blade 920 at the same angle as the chute. Still referring to FIGS. 9 and 10, the hood 901 causes the tickets 915 to be directed downward across the blade 920. If a player pulls on the tickets, the blade will cut the tickets and prevent de-reeling. In the present invention, the number of tickets may also be counted by the bar code or the optical sensor element that detects the holes at the center of the tickets. When a predetermined number of tickets have been dispensed the motor is shut off by the controller. When the motor is off, de-reeling is not as acute of a problem.

The use of the screw gear in the dispenser is an improvement over the conventional ticket dispenser because it prevents a player from pulling tickets out of the chute. In this regard, while the screw gear will drive tooth gear 120, if one attempts to pull the tickets the teeth are locked by engagement of the screw gear. Now referring to FIG. 3, the top loading feature of the present invention allows the tickets to be easily loaded through the chute. The guide may be released by movement of the clip 315 laterally thereby allowing peg 320 on the rail 318 to be released from opening 325. The ticket guide assembly 102, including the mirror, the opposite rails, the roller and the guide bar, then may be pivoted at axis 320 to allow access to the chute.

As best seen in FIG. 1, at the top of the chute 102 is blade 180 that will engage the tickets that have been awarded and assist with the tearing of the tickets in response to a downward force on the tickets. Accordingly, if the player pulls on the tickets as they are dispensed, the blade will function to cut the tickets. The ticket guide is pivotably attached to the lower chute assembly on pin 191 that intersects the sidewall 195 of the housing.

In operation, the light source emits a constant light signal which impinges on either the back of the tickets that are passing through chute 101 or on mirror 223. In this regard, between each ticket is a perforation that allows the light to directly impinge on mirror 223 and be reflected back to sensor 103. The sensor then creates a signal that includes the light that is reflected from the bar code and the areas of interruption. When the tickets are out, a constant signal of light is reflected back to the sensor and a constant signal is emitted and transmitted back to the central controller.

As best seen in FIG. 3, the ticket guide clip 315 receives peg 320 that extends from guidebar 207 and locks the ticket guide 202 into position. The tickets are thus guided along surface 215 under rails 209 and 210 and guidebar 250 and roller 205.

In an alternative contemplated embodiment, the rails and guidebar are maintained in the down position by a magnetic engagement. Referring to FIG. 3, a magnet 375 is located under the chute which attracts a ferrous metal material that is provide in the ticket guide assembly such as in guide bar. This configuration may allow a deformed ticket to pass through the chute without jamming as the guide assembly may be displaced from the down position by the deformation, pivoting on bar 320, and then will return to the down position when the deformation has passed. The use of a magnetic engagement also facilitates the reloading of tickets because the guide assembly can easily be pivoted to allow access to the chute.

In a preferred embodiment, the tickets are driven through the chute by toothed gears 115 and 116 which have teeth that extend through slots 149*a* provided through the floor of the ticket chute.

Figure 8:
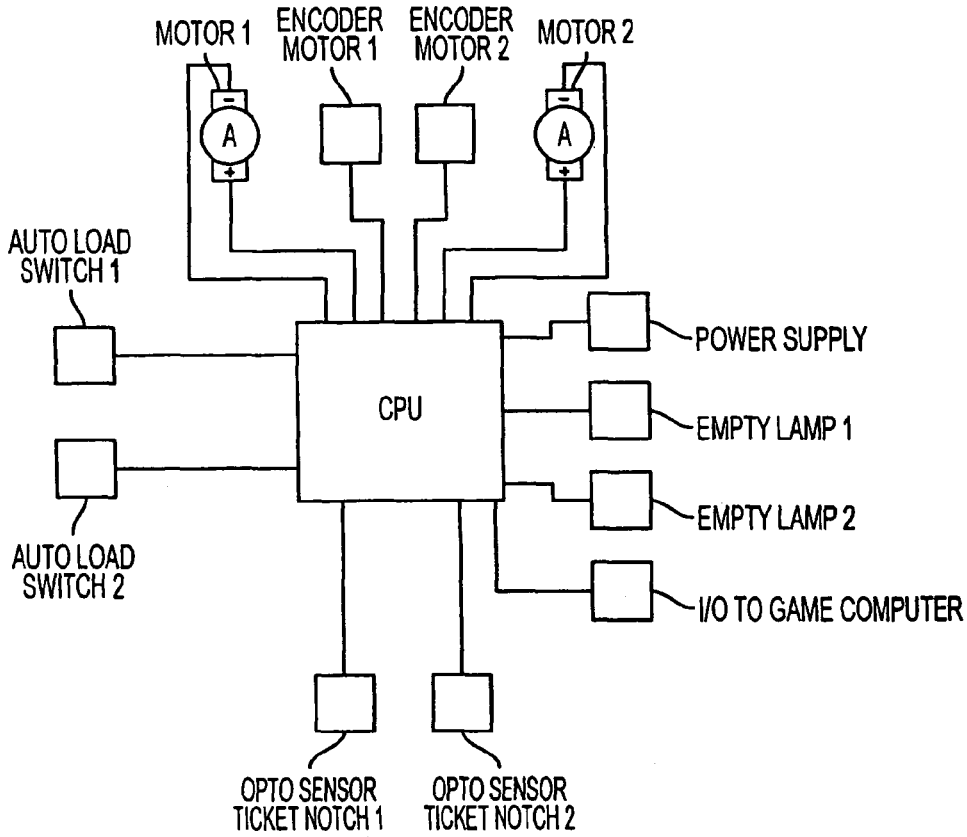
FIG. 8 is a schematic of the input and outputs to the ticket controller.

Now referring to FIG. 8, the ticket controller receives input from the game controller that includes data relating to how many tickets must be dispensed. The ticket controller then activates either motor 140 or motor 167. Motor 140 drives belt 130 that in turn drives screw gear 350. Screw gear 350 turns gear 120 which is connected to an axle that includes tooth drive gears 115 and 116. The tooth gears engage the tickets and pull the tickets from the ticket roll or ticket supply. The controller is provided with signals from the motor and the optical sensor. The signal from the optical sensor may include a signal reflecting the passage of the opening on the ticker past the detector, a signal from a bar code on the back of the ticket or both. In response to a signal reflecting the absences of tickets, or polling by the controller, the controller will deactivate a first chute and activate the second. Likewise, in the event that the signal provides information to the controller that reflects a ticket jam, the controller can activate the respective alternative motor.

The auto load switch may be used to load the tickets. Using this feature, if the operator passes the tickets in front to the optical sensor three times, the controller will interpret the signal as an autoload and the motor will begin to operate and engage the tickets and move them to the ready position wherein the first ticket is positioned at the top of the chute. The controller will then assume that the ticket dispenser will operate to distribute 6000 tickets, the amount that is typically provided by ticket manufacturers in a package.

As is apparent by the preferred embodiment of the invention, the present invention provides for dual ticket chutes that are operated by a single controller. When the operation is trouble free, the dual design allows the ticket distributor to dispense two times the number of tickets as a conventional single chute distributor. In addition, in the event that the first chute jams, the chute runs out of tickets, there is a break in the tickets causing the tickets not to feed correctly into the chute, or if the chute is otherwise rendered inoperable, the controller will receive a signal reflecting the malfunction and then activate the second chute. In a preferred embodiment the controller will also activate a lamp providing a signal to the operator that the chute requires service.

The invention having been described in detail with respect to preferred embodiments above, it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

We claim:

1. An improved device for distributing tickets comprising a ticket chute, said ticket chute comprising a floor and opposite sidewalls, a top ticket guide said guide including means to retain tickets within said chute, a motor, drive means to engage tickets and drive tickets through said chute, mechanical power transmission means to transfer power from said motor to said drive means, wherein mechanical power transmission means further comprises a screw gear arrangement, and a controller for activation said motor in response to an input signal and further comprising a hood extending over a ticket exit slot, wherein said ticket chute has an inclination toward said exit slot and said hood guides tickets distributed from said device in a downward direction, and wherein the angle of a plane formed by an interior surface of said hood and the plane formed by said ticket chute is more than 45 degrees and further comprising a ticket cutting blade, said ticket cutting blade located at the top of said chute and adjacent to the exit slot, and said cutting blade is oriented on the same angle as said chute.

2. The device as recited in claim 1 wherein said drive means comprises a toothed gear that extends through slots provided through said floor of said chute.

3. The device as recited in claim 2 wherein said means to bias said tickets against said drive means comprises a roller, said roller positioned opposite said drive means and attached to provide for rotational movement.

4. The device recited in claim 1 further comprising a means to bias tickets against said drive means.

5. The device as recited in claim 1 further comprising a controller, wherein said motor is activated and deactivated in response to signals from said controller, said device further comprising a plurality of chutes a plurality of motors and a plurality of ticket drivers, and further comprising ticket sensors and wherein said controller can activate and deactivate said motors pursuant to predetermined instructions, wherein said instructions reflect the operating condition of said dispensers detected by said ticket sensors.

6. The device as recited in claim 5 wherein said sensors further comprise a light source and optical sensors, said sensors positioned to detect tickets that pass through said chutes and whereby said sensors will send a signal to said controller that reflects the presence of tickets in said chutes.

7. The device recited in claim 6 wherein said sensors are positioned in the center of said chutes.

8. The device recited claim 6 wherein said optical sensors are located in the center of said chutes and said sensors are adapted to detect the passage of tickets and detect information from a bar code printed on said tickets and transmit said information to said controller.

9. The ticket device as recited in claim 8 further comprising a mirror, wherein said mirror reflects light from said light source so that it may impinge on a light detector, said light detector in communication with said controller, wherein when no ticket is between the mirror and the light detector a signal is detected by said light detector and sent to said controller.

10. The device recited in claim 5 further comprising a sensor to detect the rotation of said motor and said sensor generates signals relating to said rotation that are transmitted to said controller.

11. An improved device for distributing tickets comprising a ticket chute, said ticket chute comprising a floor and opposite sidewalls, a top ticket guide said guide including means to retain tickets within said chute, a motor, drive means to engage tickets and drive tickets through said chute, mechanical power transmission means to transfer power from said motor to said drive means, wherein mechanical power transmission means further comprises a screw gear arrangement, and a controller for activation said motor in response to an input signal and further comprising a top ticket guide assembly said ticket guide assembly pivotably attached to said chute to provide access to the top of said chute.

12. A method of loading a ticket dispenser with tickets comprising providing input to an optical sensor in a predetermined sequence, wherein in response to said predetermined sequence a signal is transmitted from said optical sensor to a controller, and in response to said signal said controller processes said signal and in response to said processing step resets a counter to zero and activates a motor to cause a tickets driver to drive and engage a strip of tickets and move said strip of tickets up a ticket chute to a dispensing position.

* * * * *